US006425197B2

(12) United States Patent
Ching et al.

(10) Patent No.: US 6,425,197 B2
(45) Date of Patent: Jul. 30, 2002

(54) ELECTRIC IRON

(75) Inventors: Boon Kihan Ching; Arun Sundaram, both of Singapore (SG)

(73) Assignee: Koninklijke Philips Electronics., N.V., Eindhoven (NL)

( * ) Notice: Subject to any disclaimer, the term of this patent is extended or adjusted under 35 U.S.C. 154(b) by 0 days.

(21) Appl. No.: 09/772,323

(22) Filed: Jan. 26, 2001

(30) Foreign Application Priority Data

Feb. 1, 2000 (SG) ..... 200000572

(51) Int. Cl.[7] ..... D06F 75/14
(52) U.S. Cl. ..... 38/77.3
(58) Field of Search ..... 38/77.3, 77.82, 38/77.1, 77.5

(56) References Cited

U.S. PATENT DOCUMENTS

| | | | | |
|---|---|---|---|---|
| 2,620,576 A | * | 12/1952 | Stevenson et al. | 38/77.3 |
| 2,817,169 A | * | 12/1957 | Schott | 38/77.1 |
| 4,646,451 A | * | 3/1987 | Nakao et al. | 38/77.3 |
| 5,398,434 A | * | 3/1995 | Biancalani | 38/77.3 |

FOREIGN PATENT DOCUMENTS

| | | | |
|---|---|---|---|
| EP | 0461959 A1 | 12/1991 | |
| FR | 2771424 A1 | 5/1999 | |
| WO | 9927176 A1 | 6/1999 | ..... D06F/75/14 |

* cited by examiner

*Primary Examiner*—Ismael Izaguirre
(74) *Attorney, Agent, or Firm*—Ernestine C. Bartlett

(57) ABSTRACT

An electric iron is provided which includes a housing (1), a sole plate (2), a first reservoir (6) having an outlet (12) for a first fluid (7), an exchangeable reservoir (8) having an outlet (11) for a second fluid (9), which has a viscosity, and having a coupling (14), a nozzle (10) comprising at least one aperture, a pump (19) for delivering a mixture of the first and second fluids to the nozzle (10), said coupling (14) comprising a first and a second inlet (15,16) and an outlet (17), said second inlet (16) of the coupling being fixedly connected to the outlet (11) of the exchangeable reservoir (8), the first inlet (15) of the coupling (14) and the outlet (17) of the coupling (14) being connected to the outlet (12) of the first reservoir (6) and to a supply tube (18) to the pump (19), respectively, if the exchangeable reservoir (8) is inserted into the iron, at least one of the inlets (15,16) of the coupling (14) and/or the outlet (11) of the exchangeable reservoir (8) being provided with a flow restriction (20,21) which is adapted to the viscosity of the second fluid (9) such that, given predetermined pumping characteristics of the pump (19), a predetermined desired flowrate of the mixture of fluids and/or a predetermined desired proportion of the first and second fluids (7,9) is obtained.

14 Claims, 2 Drawing Sheets

ELECTRIC IRON

FILED OF THE INVENTION

The invention relates to an electric iron comprising a housing, a sole plate, a first reservoir having an outlet for a first fluid, an exchangeable reservoir having an outlet for a second fluid, which has a viscosity, a nozzle means comprising at least one aperture and a pump for delivering a mixture of the first and second fluids to the nozzle means.

Such an electric iron is known from WO 99/27176. With this iron it is possible to spray an additive fluid on the fabric before it is ironed. Additive fluids can be used e.g. for achieving a starching effect or wrinkling resistance, or for making cloth hydrophylic or hydrophobic. The additive fluid is contained in the exchangeable reservoir, whereas the first reservoir contains water. By starting the pump, water as well as additive fluid is sucked from the respective reservoirs via supply tubes, whereby the additive fluid is diluted with water, after which the mixture of fluids (diluted additive fluid) is pumped to the spraying nozzle. Parts of both supply tubes are shaped as capillary tubes in order to create an underpressure at the inlets of the pump. These capillary tubes have flow resistances which limit the maximum flowrate. To control the flowrate of the additive fluid to the pump, the supply tube for the additive fluid is provided with an adjustable valve. This means that it is up to the user himself to control the proportion of the fluids, and thus the degree of dilution. This could induce mistakes and could even be rather risky, because there is a reasonable chance that the user will use a wrong adjustment, e.g. a too high concentration of the additive fluid causing damage to the cloth. This risk is even greater if the user decides to use a different reservoir with a different additive fluid. A different fluid will usually have a different viscosity. This means that it is left to the user's competence how great the degree of dilution should be chosen. All this may lead to mistakes.

SUMMARY OF THE INVENTION

The object of the invention is to provide an electric iron in which exchangeable reservoirs containing additive fluids, possibly of different viscosity and in a concentrated form, can be used without the risk of the above problems arising.

According to the invention, the electric iron comprises a housing, a sole plate, a first reservoir having an outlet for a first fluid, an exchangeable reservoir having an outlet for a second fluid, which has a viscosity, and having coupling means, a nozzle means comprising at least one aperture, a pump for delivering a mixture of the first and second fluids to the nozzle means, said coupling means comprising a first and a second inlet and an outlet, said second inlet of the coupling being fixedly connected to the outlet of the exchangeable reservoir, the first inlet of the coupling and the outlet of the coupling being connected to the outlet of the first reservoir and to a supply tube to the pump, respectively, if the exchangeable reservoir is inserted into the iron, at least one of the inlets of the coupling and/or the outlet of the exchangeable reservoir being provided with a flow restriction which is adapted to the viscosity of the second fluid such that, given predetermined pumping characteristics of the pump, a predetermined desired flowrate of the mixture of fluids and/or a predetermined desired proportion of the first and second fluids is obtained. Every exchangeable reservoir which can be used in such an iron has its own flow restriction for the first or the second fluid or both. The flow restriction is so designed that the maximum flowrate through the inlet causes a predetermined, desired flowrate of the mixture of fluids to be delivered through the aperture of the nozzle means. It is the manufacturer of the exchangeable reservoir who determines the degree of concentration of the mixture of the fluids, not the user.

In a preferred embodiment of the iron, the second inlet of the coupling is provided with a non-return valve. This prevents liquid from flowing into or out of the exchangeable reservoir when the pump is not in operation.

In a further preferred embodiment, the outlet of the first reservoir is provided with a non-return valve. This also prevents liquid from flowing into or out of the exchangeable reservoir when the pump is not in operation. If the exchangeable reservoir is removed, it will prevent leakage.

Preferably, the exchangeable reservoir is provided with a vent and the iron is provided with a valve for opening or closing said vent. Closing the vent offers the possibility to deliver only the first fluid to the nozzle means, without the second fluid.

In a further embodiment, the outlet of the coupling is provided with a filter. The filter prevents impurities from entering the pump, which impurities could cause damage to the pump or clogging of the nozzle means.

In yet another embodiment, the aperture(s) of the nozzle means is (are) located in the sole plate.

The invention also relates to an exchangeable reservoir intended for use in the iron and having characteristics as described in the claims.

These and other aspects of the invention will be apparent from and elucidated with reference to the embodiments described hereinafter.

DETAILED DESCRIPTION OF THE INVENTION

Figure 1:
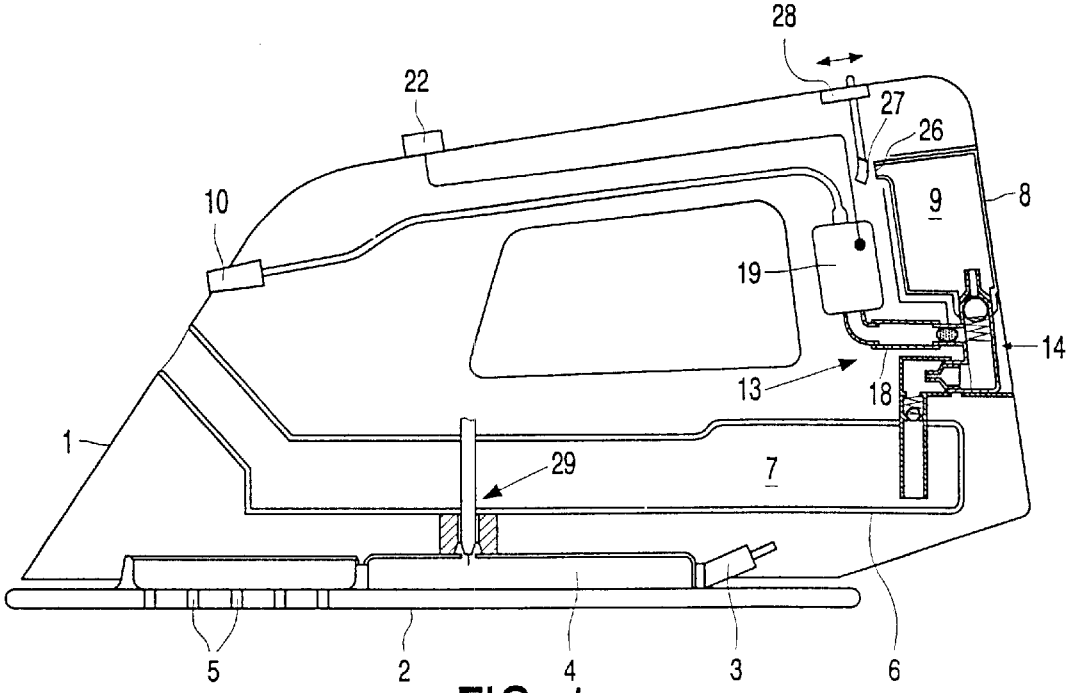
FIG. 1 is a diagrammatic view of an iron, in which an exchangeable reservoir is arranged.
Figure 2:
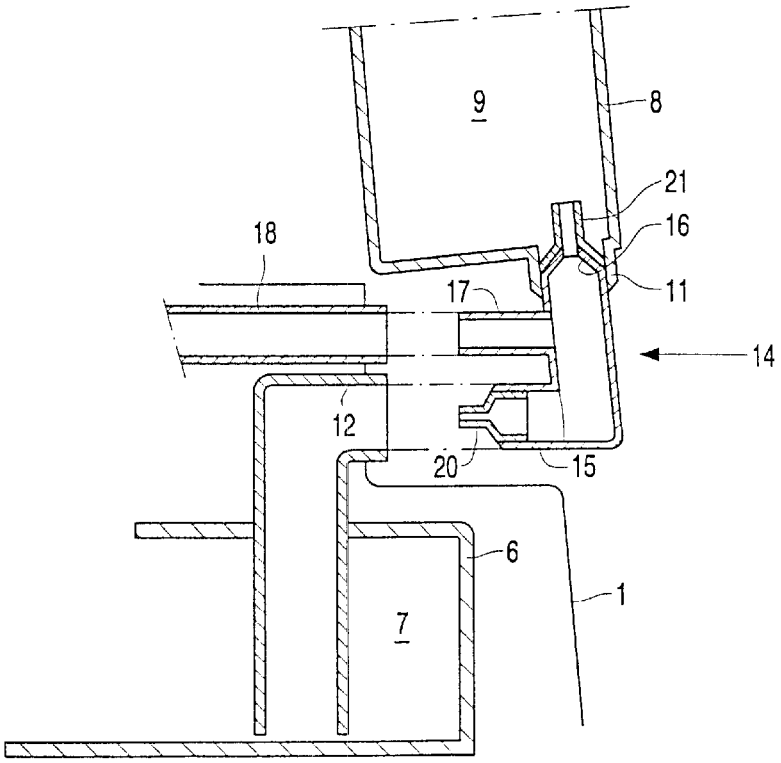
FIG. 2 is a detailed view of the exchangeable reservoir according to a first embodiment and FIG. 3 is a detailed view of the exchangeable reservoir according to a second embodiment.

An iron according to the invention as shown in FIGS. 1 and 2 comprises a housing 1, a sole plate 2, a heating element 3, a steam chamber 4, steam outlet ports 5, a first reservoir 6 for containing a fluid 7, preferably water, an exchangeable reservoir 8 for a second fluid 9 and a spraying nozzle 10. The exchangeable reservoir may be a kind of cassette with a hard synthetic resin housing, or a kind of flexible bag. The fluid 9 in the exchangeable reservoir is a so-called additive fluid in a concentrated form with a certain viscosity. The exchangeable reservoir 8 is provided with an outlet 11 for the fluid 9. The reservoir 6 is provided with an outlet 12 for the fluid 7. The iron comprises a delivery system 13 for delivering a mixture of the first and second fluids to the nozzle 10 in order to be sprayed on the cloth to be ironed. The delivery system comprises a coupling 14, which is a fixed part of the exchangeable reservoir 8. The coupling has a first inlet 15 which in operation is connected to the outlet 12 of the first reservoir 6, a second inlet 16 which in operation is connected to the outlet 11 of the exchangeable reservoir 8, and an outlet 17 which in operation is connected to an inlet tube 18 to a pump 19. The first inlet 15 of the coupling 14 is provided with a flow restriction 20 and the second inlet 16 of the coupling is provided with a flow restriction 21. If a user wants to spray liquid on the cloth, the pump 19 can be started by a push button 22. Liquids from both reservoirs 6 and 8 are sucked into the coupling 14 and a mixture of these fluids is conveyed through the outlet 17 of the coupling and then through the tube 18 to the pump 19 and from there to the nozzle 10.

The total flowrate of the mixture of fluids is determined by a number of factors. One factor is the characteristic of the pump. Another factor is the restriction at the nozzle 10. Other important factors are the flow restrictions of the inlets of the coupling 14. It is important that during spraying the proportion of the two fluids, i.e. the concentration of the additive in the mixture of fluids (degree of dilution of additive fluid) should remain constant. This proportion is prescribed by the manufacturer. The flowrate of the first fluid 7 from the first reservoir 6 is determined by the flow restriction 20 located in the inlet 15 of the coupling 14, and the flowrate of the second fluid 9 from the exchangeable reservoir 8 is determined by the flow restriction 21 located in the inlet 16 of the coupling 14. Each exchangeable reservoir 8 has its own flow restriction which is adapted to the viscosity of the fluid 9. This means that the proportion of the two fluids (degree of dilution) is determined by the flow restrictions 20 and 21. The flowrate of the mixture is also determined by these flow restrictions. In this way the concentration and the flowrate of the mixture of fluids are at the predetermined desired values.

The table below gives an example of the use of flow restrictions 20 and 21 to achieve the desired mixing proportions for three different second (additive) fluids A, B and C.

| | Additive concentrate | | |
|---|---|---|---|
| | A | B | C |
| Viscosity of additive concentrate (cps) | 50 | 50 | 150 |
| desired mixing ratio (water/additive concentrate) | 6:1 | 12:1 | 12:1 |
| flow restriction 20 (at first inlet 15) | Ø: 1.5 mm L: 3 mm | Ø: 2.5 mm L: 3 mm | Ø: 1.0 mm L: 3 mm |
| flow restriction 21 (at second inlet 16) | Ø: 2.5 mm L: 3 mm | Ø: 1.0 mm L: 3 mm | Ø: 4.0 mm L: 3 mm |

Figure 3:
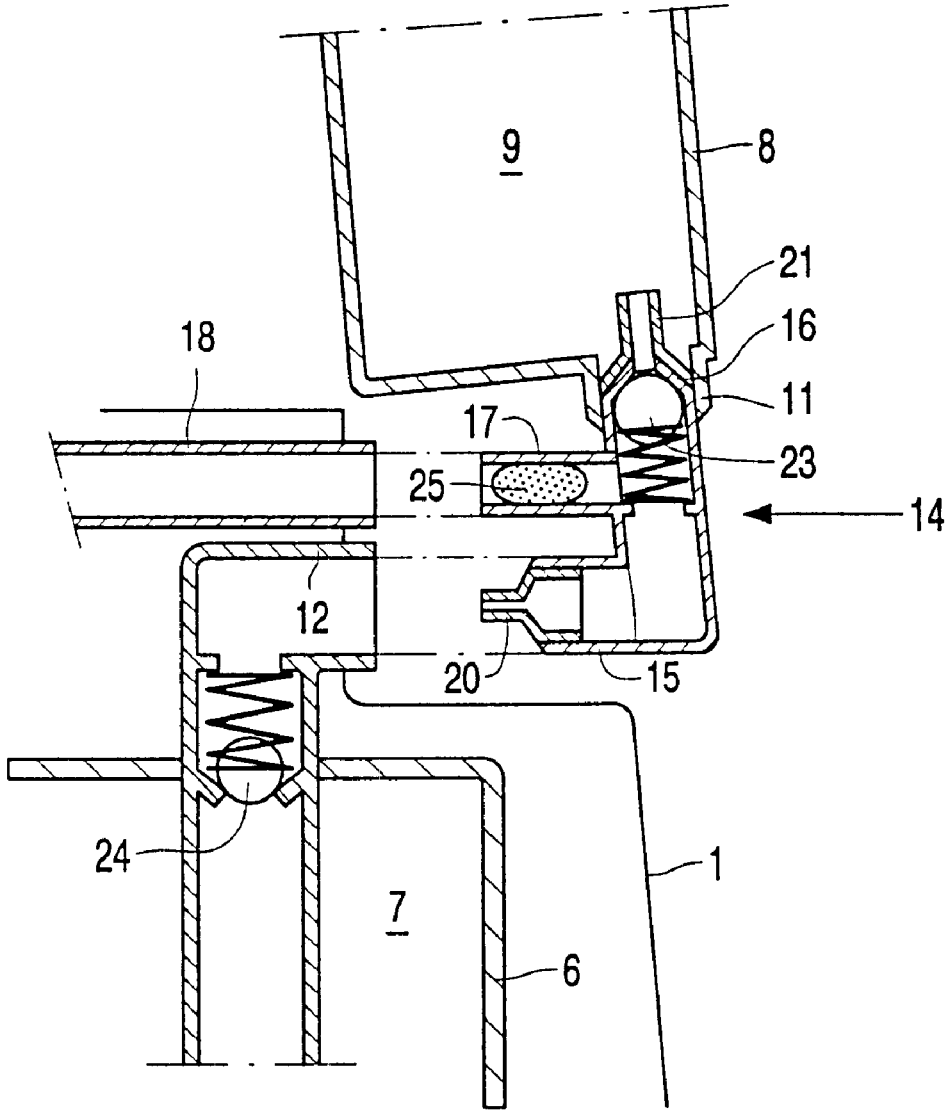

FIG. 3 shows a further embodiment of FIG. 2. The second inlet 16 of the coupling 14 is provided with a non-return valve 23. This prevents liquid from flowing into or out of the exchangeable reservoir when the pump is not in operation. The outlet 12 of the first reservoir 6 can also be provided with a non-return valve 24. This also prevents liquid from flowing into or out of the reservoir when the pump is not in operation. Moreover, if the exchangeable reservoir is removed, it prevents a leakage.

The outlet 17 of the coupling 14 may be provided with a filter 25. The filter prevents impurities from entering the pump which could cause damage to the pump or clogging of the nozzle means.

The exchangeable reservoir 8 may be provided with a vent 26 (see FIG. 1). With the aid of valve means 27, the vent 26 can be opened or closed, e.g. by means of a knob 28 located on the housing 1 of the iron. By closing the vent the user can spray only the first fluid, e.g. water on the cloth.

The iron can be used as a steam iron. Water from the first reservoir 6 enters the steam chamber 4 through a dosing system 29 for generating steam which is conveyed to the steam outlet ports 5.

It is also possible to locate the apertures of the nozzle means in the sole plate.

What is claimed is:

1. An electric iron comprising a housing, a sole plate, a first reservoir having an outlet for a first fluid, an exchangeable reservoir having an outlet for a second fluid, which has a viscosity, and having coupling means, a nozzle means comprising at least one aperture, a pump for delivering a mixture of the first and second fluids to the nozzle means, said coupling means comprising a first and a second inlet and an outlet, said second inlet of the coupling being fixedly connected to the outlet of the exchangeable reservoir, the first inlet of the coupling and the outlet of the coupling being connected to the outlet of the first reservoir and to a supply tube to the pump, respectively, if the exchangeable reservoir is inserted into the iron, at least one of the inlets of the coupling and/or the outlet of the exchangeable reservoir being provided with a flow restriction that includes a portion having a lessened dimension when compared to the dimension of said inlet or said outlet, which flow restriction is adapted to the viscosity of the second fluid such that, given predetermined pumping characteristics of the pump, a predetermined desired flowrate of the mixture of fluids and/or a predetermined desired proportion of the first and second fluids is obtained.

2. An iron as claimed in claim 1, wherein the second inlet of the coupling is provided with a non-return valve.

3. An iron as claimed in claim 1, wherein the outlet of the first reservoir is provided with a non-return valve.

4. An iron as claimed in claim 1, wherein the exchangeable reservoir is provided with a vent and the iron is provided with a valve for opening or closing the vent.

5. An iron as claimed in claim 1, wherein the outlet of the coupling is provided with a filter.

6. An iron as claimed in claim 1, wherein the coupling is integrated with the exchangeable reservoir.

7. An iron as claimed in claim 1, wherein the aperture(s) of the nozzle means are located in the sole plate.

8. An iron as claimed in claim 1, wherein the second fluid is an additive fluid in concentrated form.

9. An exchangeable reservoir for use with an iron as claimed in claim 1, said exchangeable reservoir comprising a fluid, wherein the reservoir is provided with a coupling which comprises a first inlet for coupling to the outlet of a first reservoir, a second inlet fixedly connected to the outlet of the exchangeable reservoir, and an outlet for coupling to a pump, and wherein at least one of the inlets of the coupling is provided with a flow restriction.

10. An exchangeable reservoir as claimed in claim 9, wherein the second inlet of the coupling is provided with a non-return valve.

11. An exchangeable reservoir as claimed in claim 9, wherein the exchangeable reservoir is provided with a vent having an on/off valve.

12. An exchangeable reservoir as claimed in claim 9, wherein the outlet of the coupling is provided with a filter.

13. An exchangeable reservoir as claimed in claim 9, wherein the coupling is integrated with the exchangeable reservoir.

14. An exchangeable reservoir as claimed in claim 9, wherein the exchangeable reservoir contains an additive fluid in concentrated form.

* * * * *